US011015591B2

(12) United States Patent
Sanford

(10) Patent No.: US 11,015,591 B2
(45) Date of Patent: May 25, 2021

(54) GAS OPERATED INFINITE STEP VALVE

(71) Applicant: DRESSER-RAND COMPANY, Olean, NY (US)

(72) Inventor: Joel T. Sanford, Bath, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 240 days.

(21) Appl. No.: 16/301,197

(22) PCT Filed: Jun. 29, 2017

(86) PCT No.: PCT/US2017/039891
§ 371 (c)(1),
(2) Date: Nov. 13, 2018

(87) PCT Pub. No.: WO2018/009402
PCT Pub. Date: Jan. 11, 2018

(65) Prior Publication Data

US 2019/0293064 A1 Sep. 26, 2019

Related U.S. Application Data

(60) Provisional application No. 62/359,389, filed on Jul. 7, 2016.

(51) Int. Cl.
*F04B 49/03* (2006.01)
*F04B 53/10* (2006.01)
(Continued)

(52) U.S. Cl.
CPC ..... *F04B 49/03* (2013.01); *F04B 49/02* (2013.01); *F04B 49/06* (2013.01); *F04B 49/243* (2013.01); *F04B 53/10* (2013.01)

(58) Field of Classification Search
CPC ..... F04B 39/08; F04B 49/03; F04B 49/243; F04B 49/02; F04B 49/06; F04B 49/225; F04B 49/24; F04B 53/10; F04B 53/1012
See application file for complete search history.

(56) References Cited

U.S. PATENT DOCUMENTS 4,270,885 A * 6/1981 Shaffer ..... F04C 28/24 417/279
4,445,824 A * 5/1984 Bunn ..... F04B 49/24 417/440

(Continued)

FOREIGN PATENT DOCUMENTS

DE 1114272 B 9/1961
WO 2007120506 A2 10/2007
WO 2012122203 A2 9/2012

OTHER PUBLICATIONS

PCT International Search Report and Written Opinion of International Searching Authority dated Oct. 13, 2017 corresponding to PCT International Application No. PCT/US2017/039891 filed Jun. 29, 2017.

*Primary Examiner* — Dominick L Plakkoottam

(57) ABSTRACT

An inlet valve system for a cylinder chamber of a reciprocating compressor and a method for unloading the inlet valve system are provided. The inlet valve system may include an unloader, a valve assembly including a cylindrical valve body circumferentially disposed about a central axis of the inlet valve system, and a control valve actuator including a control valve body circumferentially disposed about the central axis of the inlet valve system. A control valve passage of the control valve body may extend along the central axis of the inlet valve system, a control valve element may be disposed in the control valve passage, and a control pressure source may be fluidly coupled to the control valve passage.

19 Claims, 6 Drawing Sheets

(51) Int. Cl.

| | |
|---|---|
| ***F04B 49/24*** | (2006.01) |
| ***F04B 49/06*** | (2006.01) |
| ***F04B 49/02*** | (2006.01) |

(56) References Cited

U.S. PATENT DOCUMENTS

| | | | | |
|---|---|---|---|---|
| 5,139,051 | A * | 8/1992 | Walstad | F04B 49/02 137/630 |
| 8,070,461 | B2 * | 12/2011 | Sanford | F04B 39/08 417/306 |
| 8,308,455 | B2 * | 11/2012 | Wallis | F04B 27/24 417/440 |
| 8,496,454 | B2 * | 7/2013 | Wallis | F04B 27/24 417/440 |
| 9,377,018 | B2 * | 6/2016 | Mangiagli | F04B 49/06 |
| 10,036,376 | B2 * | 7/2018 | Mitsch | B61H 11/08 |
| 2012/0189467 | A1 * | 7/2012 | Allenspach | F04B 49/243 417/53 |
| 2012/0207623 | A1 * | 8/2012 | Allenspach | F04B 39/08 417/53 |

* cited by examiner

GAS OPERATED INFINITE STEP VALVE

This application claims the benefit of U.S. Provisional Patent Application having Ser. No. 62/359,389, which was filed Jul. 7, 2016. The aforementioned patent application is hereby incorporated by reference in its entirety into the present application to the extent consistent with the present application.

Reciprocating compressors are a type of compressor used for pressurizing and/or compressing process gases or fluids. The typical reciprocating compressor includes a cylinder or other body defining a cylinder or compression chamber and a piston movably disposed therein. The structure of the reciprocating compressor provides linear reciprocating displacement of the piston within the cylinder chamber to compress the process fluid located within the cylinder chamber, which is subsequently discharged at the increased pressure.

To better control the maximum pressure in the compressor and/or the output rate of the compressed process fluid, reciprocating compressors may include an unloader that provides a fixed volume chamber removably connectable with the cylinder chamber. In general, a valve assembly controls the flow between the cylinder chamber and the unloader chamber and determines when the process fluid is able to move between the two chambers and alternatively when the chambers are sealed or isolated from each other. For example, an infinite step control (ISC) valve system may be used to unload an inlet valve of the reciprocating compressor by holding the inlet valve open longer than in a typical cycle for allowing process gas to re-enter the inlet passage of the unloader.

The ISC valve system includes a finger/plunger valve assembly that has a plurality of fingers or connecting rods extending from a common plate, where each finger is coupled to a respective plunger used to open or close a gaseous passageway. The common plate is typically connected to a hydraulic cylinder. The ISC valve system holds the inlet valve open by depressing the finger/plunger assembly via the hydraulic cylinder which in turn is controlled by a servo valve.

What is needed, then, is an improved inlet valve system for infinite step control and a method for unloading the inlet valve system coupled to a cylinder chamber of a reciprocating compressor.

Embodiments of the disclosure may provide an inlet valve system for a cylinder chamber of a reciprocating compressor. The inlet valve system may include an unloader including a cylindrical unloader body circumferentially disposed about a central axis of the inlet valve system and having an enclosed end opposite an open end. The unloader may also include a central bore extending between the enclosed end and the open end within the cylindrical unloader body and defining an unloader chamber, and an inlet passage defined by the cylindrical unloader body and configured to provide fluid communication between the central bore and a location external of the cylindrical unloader body. The inlet valve system may also include a valve assembly including a cylindrical valve body circumferentially disposed about the central axis of the inlet valve system and having a first end opposite a second end. The valve assembly may also include a plurality of first valve passages, a plurality of second valve passages, a first connective passage, a second connective passage, a plurality of inlet valve elements disposed in a plurality of valve element ports, and a central bore extending between the first end and the second end of the cylindrical valve body and along the central axis of the inlet valve system. The valve assembly may be disposed at the open end of the cylindrical unloader body, the plurality of first valve passages may extend between the first end of the cylindrical valve body and the first connective passage, and each of the first valve passages may have a valve seating surface adjacent the first connective passage. The plurality of second valve passages may extend between the second end of the cylindrical valve body and the first connective passage, and the second connective passage may extend between the plurality of valve element ports and the central bore of the cylindrical valve body. Each valve element port may at least partially contain a respective inlet valve element of the plurality of inlet valve elements. Each inlet valve element may be configured to move between a closed position and an opened position by applying differential gas pressures to a front element surface and a rear element surface of the inlet valve element, engage the valve seating surface of the first valve passage adjacent the first connective passage in the closed position when applying a greater pressure to the rear element surface than the front element surface, and disengage the valve seating surface of the first valve passage adjacent the first connective passage in the opened position when applying a greater pressure to the front element surface than the rear element surface. The inlet valve system may further include a control valve actuator including a control valve body circumferentially disposed about the central axis of the inlet valve system and having a first end opposite a second end, a control valve passage of the control valve body extending along the central axis of the inlet valve system, a control valve element disposed in the control valve passage, and a control pressure source fluidly coupled to the control valve passage.

Embodiments of the disclosure may further provide an inlet valve system for a cylinder chamber of a reciprocating compressor. The inlet valve system may include an unloader including a cylindrical unloader body circumferentially disposed about a central axis of the inlet valve system and having an enclosed end opposite an open end. The unloader may also include a central bore extending between the enclosed end and the open end within the cylindrical unloader body and defining an unloader chamber, and an inlet passage defined by the cylindrical unloader body and configured to provide fluid communication between the central bore and a location external of the cylindrical unloader body. The inlet valve system may also include a valve assembly including a cylindrical valve body circumferentially disposed about the central axis of the inlet valve system and having a first end opposite a second end. The valve assembly may also include a plurality of first valve passages, a plurality of second valve passages, a first connective passage, a second connective passage, a plurality of inlet valve elements disposed in a plurality of valve element ports, and a central bore extending between the first end and the second end of the cylindrical valve body and along the central axis of the inlet valve system. The valve assembly may be disposed at the open end of the cylindrical unloader body, the plurality of first valve passages may extend between the first end of the cylindrical valve body and the first connective passage, and each of the first valve passages may have a valve seating surface adjacent the first connective passage. The plurality of second valve passages may extend between the second end of the cylindrical valve body and the first connective passage, and the second connective passage may extend between the plurality of valve element ports and the central bore of the cylindrical valve body. Each valve element port may at least partially contain a respective inlet valve element of the plurality of inlet valve elements.

Each inlet valve element may be configured to move between a closed position and an opened position by applying differential gas pressures to a front element surface and a rear element surface of the inlet valve element. The inlet valve system may further include a control valve actuator including a control valve body circumferentially disposed about the central axis of the inlet valve system and having a first end opposite a second end, a control valve passage of the control valve body extending along the central axis of the inlet valve system, a control pressure source fluidly coupled to the control valve passage, and a control valve element disposed in the control valve passage. The control valve actuator may also include a first valve seating surface disposed on the control valve body, axially aligned with the control valve element and the control valve passage of the control valve body, and adjacent the second connective passage. The control valve actuator may further include a second valve seating surface disposed on the cylindrical valve body, axially aligned with the control valve element and the central bore of the cylindrical valve body, and adjacent the second connective passage.

Embodiments of the disclosure may further provide a method for unloading an inlet valve system coupled to a cylinder chamber of a reciprocating compressor. The method may include flowing a process fluid from an unloader, through a valve assembly, and into the cylinder chamber. The valve assembly may include a plurality of inlet valve elements, where each inlet valve element is disengaged with a valve seating surface in an opened position for providing the process fluid to flow through the valve assembly. Each inlet valve element may have a front element surface and a rear element surface, and the process fluid may apply a first pressure to each of the front element surfaces. The method may also include flowing a control gas to the rear element surfaces. The control gas may apply a second pressure to each of the rear element surfaces to maintain each of the inlet valve elements disengaged with the valve seating surface in the opened position, and the second pressure may be less than the first pressure. The method may further include adjusting a control valve actuator to cease the control gas flowing to the rear element surface and flow a cylinder gas from the cylinder chamber to the rear element surface. The cylinder gas may apply a third pressure to each of the rear element surfaces and may move each of the inlet valve elements to engage the valve seating surfaces in a closed position, and the third pressure may be greater than the first pressure. The method may also include adjusting the control valve actuator to cease the cylinder gas flowing to the rear element surface and flow the control gas to the rear element surfaces. The control gas may apply the second pressure to each of the rear element surfaces to disengage each of the inlet valve elements from the valve seating surface in the opened position, and the second pressure may be less than the first pressure.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
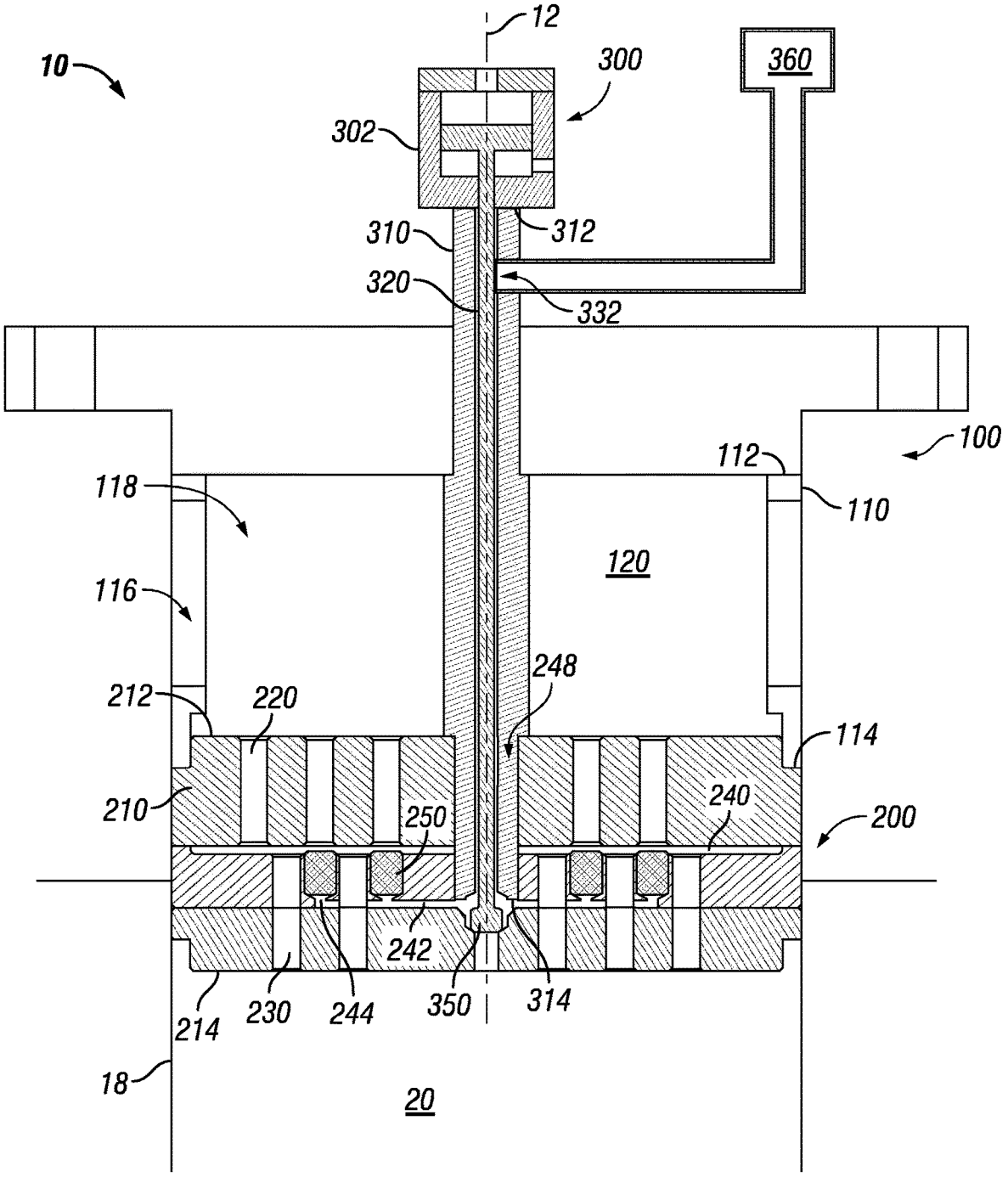
FIG. 1 depicts a cross-sectional view of an exemplary inlet valve system containing an unloader, a valve assembly, and a control valve actuator and coupled to a cylinder chamber of a reciprocating compressor, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 depicts a cross-sectional view of an exemplary inlet valve system 10 may be fluidly coupled to a compression or cylinder chamber 20 defined by a cylinder 18 of a reciprocating compressor (not shown), according to one or more embodiments. The inlet valve system 10 may be used for infinite step control and may include one or more unloaders 100, one or more valve assemblies 200, and one or more control valve actuators 300 (one each of the unloader 100, the valve assembly 200, and the control valve actuator 300 is shown in the Figures). The valve assembly 200 may be coupled to and in fluid communication with the unloader 100 and the control valve actuator 300, and the unloader 100 may be coupled to the control valve actuator 300, as will be discussed and described below.

The unloader 100 may include a cylindrical unloader body 110 circumferentially disposed about a central axis 12 of the inlet valve system 10. The cylindrical unloader body 110 may have an enclosed end 112 opposite an open end 114 and a central bore 118 extending between the enclosed end 112 and the open end 114 within the cylindrical unloader body 110 and defining an unloader chamber 120. The cylindrical unloader body 110 may have one or more inlet passages 116 defined by and passing therethrough the cylindrical unloader body 110. Each of the inlet passages 116 may be configured to provide fluid communication between the central bore 118 and a location external or outside of the cylindrical unloader body 110, as well as between the unloader chamber 120 and the location external or outside of the cylindrical unloader body 110. For example, one or more process fluids or gases may be transferred from the location external or outside of the cylindrical unloader body 110 via a conduit (not shown), through the inlet passage 116, and into the unloader chamber 120. The unloader chamber 120 may provide a fixed or constant volume for containing the process fluid prior to unloading or otherwise transferring to the cylinder chamber 20.

Figure 2A:
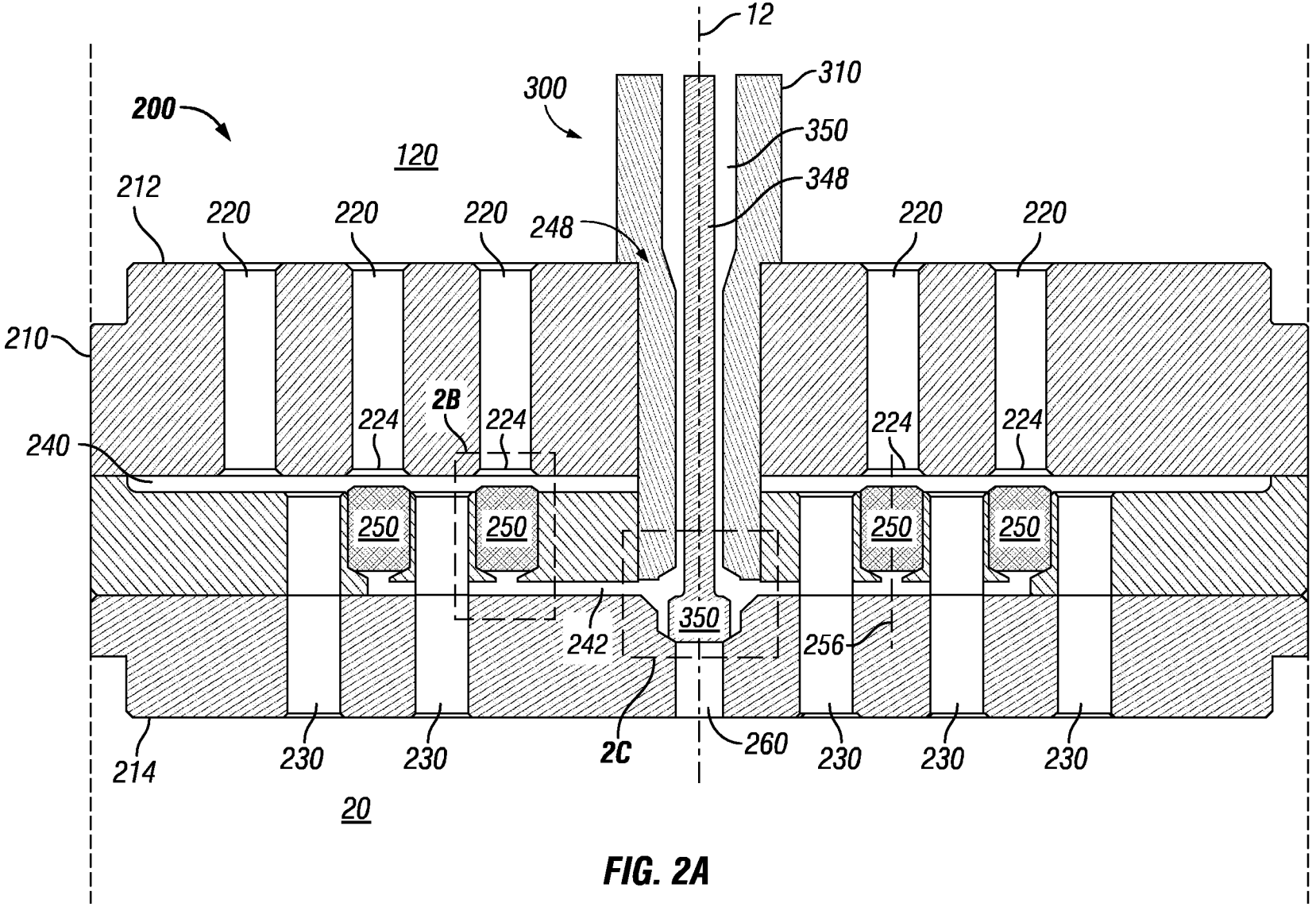
FIGS. 2A-2C depict enlarged views of the valve assembly and the control valve actuator in an inlet valve opened position, according to one or more embodiments.
Figure 2C:
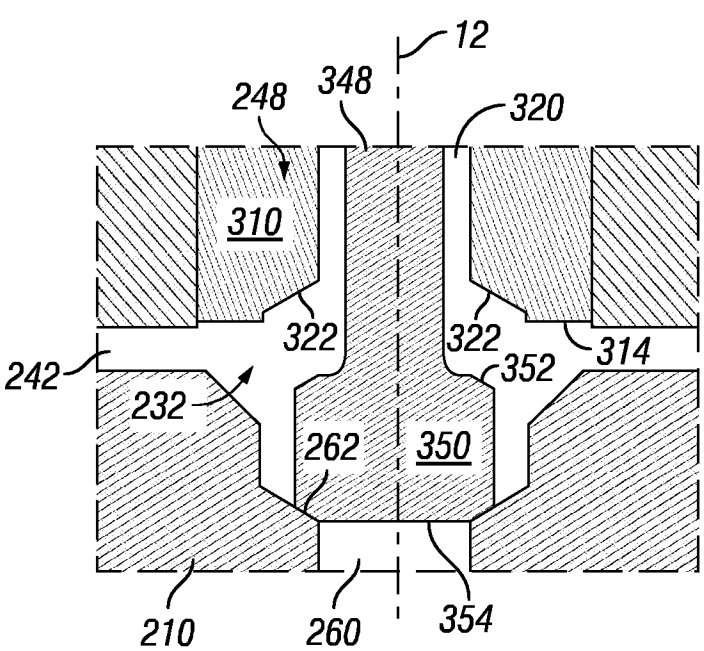
Figure 2B:
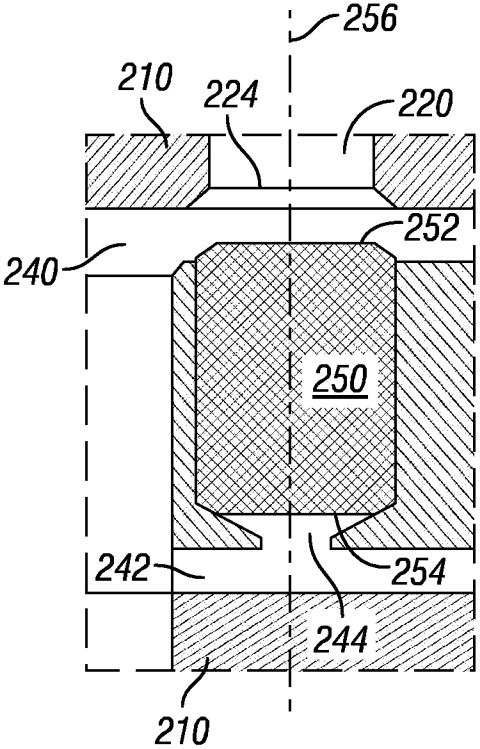

As further illustrated in FIG. 1, as well as in FIGS. 2A-2C, the valve assembly 200 may include a valve body, illustrated as a cylindrical valve body 210, circumferentially disposed about the central axis 12 of the inlet valve system 10. Although illustrated as cylindrical in FIGS. 1 and 2A-2C, the valve body may be non-cylindrical in one or more embodiments. The valve assembly 200 may be disposed at the open end 114 of the cylindrical unloader body 110. The cylindrical valve body 210 may have a first end 212 opposite a second end 214, and may be formed from or include a single unitary piece or two, three, or more pieces, such as metal-containing plates.

The cylindrical valve body 210 may also include a plurality of first valve passages 220, a plurality of second valve passages 230, one or more first connective passages 240, one or more second connective passages 242, a plurality of inlet valve elements 250 disposed in a plurality of valve element ports 244, and a central bore 248. The plurality of first valve passages 220 may extend between the first end 212 of the cylindrical valve body 210 and the first connective passage 240. The plurality of first valve passages 220 may extend in a vertical direction parallel with the central axis 12 of the inlet valve system 10. The first connective passage may extend in a horizontal direction perpendicular to the central axis 12 of the inlet valve system 10. Each of the first valve passages 220 may have a valve seating surface 224 adjacent the first connective passage 240. Each of the valve seating surfaces 224 may be configured to receive the inlet valve element 250.

The plurality of second valve passages 230 may extend between the second end 214 of the cylindrical valve body 210 and the first connective passage 240. The plurality of second valve passages 230 may extend in a vertical direction parallel with the central axis 12 of the inlet valve system 10. The second connective passage 242 may extend in a horizontal direction perpendicular to the central axis 12 of the inlet valve system 10. The second connective passage 242 may extend between the plurality of valve element ports 244 and the control valve passage 320 of the control valve body 310, as depicted in FIG. 2B. The second connective passage 242 may also extend between the plurality of valve element ports 244 and the central bore 248 of the cylindrical valve body 210, as depicted in FIG. 2C. Although the first valve passages 220 and the second valve passages 230 may extend in the vertical direction parallel with the central axis 12, the plurality of first valve passages 220 may also extend in a staggered or off-set configuration relative to the plurality of second valve passages 230 at the first connective passage 240.

Each valve element port 244 may include a respective inlet valve element 250, such that the inlet valve element 250 may be at least partially contained in the valve element port 244 and may be moved back and forth within the valve element port 244 to engage or disengage the respective valve seating surface 224. Each first valve passage 220 has a respective valve seating surface 224 that may be axially aligned with the respective inlet valve element 250 and the respective valve element port 244 relative to a respective axis 256 of the respective first valve passage 220. Each inlet valve element 250 may be moved between a closed position and an opened position by applying differential gas pressures to a front element surface 252 and a rear element surface 254 of the inlet valve element 250. For example, the inlet valve element 250 may be moved to disengage the valve seating surface 224 of the first valve passage 220 adjacent the first connective passage 240 in the opened position when applying a greater pressure to the front element surface 252 than the rear element surface 254, as depicted in FIG. 2B. Also, the inlet valve element 250 may be moved to engage the valve seating surface 224 of the first valve passage 220 adjacent the first connective passage 240 in the closed position when applying a greater pressure to the rear element surface 254 than the front element surface 252, as depicted in FIG. 3B.

The central bore 248 of the cylindrical valve body 210 may extend between the first end 212 and the second end 214 and along the central axis 12 of the inlet valve system 10. The central bore 248 may include at least a portion of the control valve actuator 300 disposed therein. For example, as depicted in FIG. 2A, the portion of the control valve actuator 300 can extend from the first end 212 of the cylindrical valve body 210 to or adjacent the second connective passage 242. The central bore 248 may also include one or more ports 260 extending between and in fluid communication with the second connective passage 242 and the inlet valve system 10, as depicted in FIG. 2A.

The control valve actuator 300 may include a control valve body 310 circumferentially disposed about the central axis 12 of the inlet valve system 10 and may have a first end 312 opposite a second end 314. The control valve body 310 may include a control valve passage 320 extending through at least a portion of the control valve body 310. The control valve body 310 and the control valve passage 320 may extend along the central axis 12 of the inlet valve system 10. The control valve actuator 300 may also include a control valve element 350 disposed in the control valve passage 320. The control valve element 350 may include one or more stems 348 coupled thereto. The control valve element 350 may be controlled to laterally move along the central axis 12 of the inlet valve system 10 via one or more controllers 302.

The control valve actuator 300 may be or include a direct solenoid, a pneumatic solenoid, a hydraulic solenoid, or any combination thereof.

One or more control pressure sources 360 may be coupled to and in fluid communication with the control valve actuator 300 via the control valve passage 320 at point 332, as depicted in FIG. 1. The control pressure source 360 may contain one or more control gases or fluids that may be used to apply the second pressure to each of the rear element surfaces 254 for maintaining each of the inlet valve elements 250 disengaged with the valve seating surface 224 in the opened position. The control pressure source 360 may be fluidly coupled to the control valve passage 320 so that the pressure of the control gas at point 332 may be regulatorly controlled to minimize any leakage or may allow the control pressure to be kept internal to the control valve passage 320. The control gas may be or include, but is not limited to, air, nitrogen, argon, helium, or any mixture thereof. The control gas may be or include one or more gases and/or one or more fluids having a gaseous state, a liquid state, a supercritical state, or any mixture thereof.

The inlet valve system 10 may also include a first valve seating surface 322 disposed on the control valve body 310, axially aligned with the control valve element 350 and the control valve passage 320 of the control valve body 310, and adjacent the second connective passage 242, and a second valve seating surface 262 disposed on the cylindrical valve body 210, axially aligned with the control valve element 350 and the central bore 248 of the cylindrical valve body 210, and adjacent the second connective passage 242. The control valve element 350 may be a reciprocating poppet valve element, a rotary valve element, or one or more other types of valve elements.

The control valve element 350 may have a first surface 352 opposite a second surface 354. The lower or second surface 354 on the control valve element 350 may be configured to engage the second valve seating surface 262 disposed on the cylindrical valve body 210, close, prohibit, or otherwise cease, fluid communication between the second connective passage 242 and the cylinder chamber 20 of the cylinder 18 at the port 260, and open, allow, or otherwise enable fluid communication between the second connective passage 242 and the control pressure source 360, as depicted in FIG. 2C. The upper or first surface 352 of the control valve element 350 may be configured to engage the first valve seating surface 322 disposed on the control valve body 310, close, prohibit, or otherwise cease fluid communication between the second connective passage 242 and the control pressure source 360, and open, allow, or otherwise enable fluid communication between the second connective passage 242 and the cylinder chamber 20 of the cylinder 18, as depicted in FIG. 3C.

In view of FIG. 1, one or more process fluids or gases may be transferred from the location external or outside of the cylindrical unloader body 110, through the inlet passage 116, and into the unloader chamber 120 and the plurality of first valve passages 220. The flow path of the process fluid passing from the unloader chamber 120 and the plurality of first valve passages 220 and into the cylinder chamber 20 will be further discussed and described below and in view of FIGS. 2A-2C and 3A-3C.

FIGS. 2A-2C depict enlarged views of the valve assembly 200 and the control valve actuator 300 in an inlet valve opened position, such as for transferring a process fluid or gas from the unloader chamber 120 to the cylinder chamber 20, according to one or more embodiments. The process fluid may flow or otherwise pass from the unloader chamber 120 and the plurality of first valve passages 220, through the valve seating surfaces 224, into the first connective passage 240 and across the front element surfaces 252 of the inlet valve element 250, through the plurality of second valve passages 230, and into the cylinder chamber 20. The process fluid may be at the first pressure that may be applied to the front element surfaces 252 of the inlet valve element 250. The first pressure of the process fluid applied at the front element surfaces 252 of the inlet valve element 250 is greater than the second pressure of the control gas applied to the rear element surfaces 254 of the inlet valve elements 250 and therefore maintains each of the inlet valve elements 250 disposed further within the respective valve element port 244 and disengaged with the respective valve seating surface 224, as depicted in FIG. 2B.

The second pressure of the control gas may be regulated by maintaining the control valve element 350 disengaged from the first valve seating surface 322 and engaged with the second valve seating surface 262, as depicted in FIG. 2C. More specifically, the second pressure of the control gas may be regulated by maintaining the first surface 352 of the control valve element 350 disengaged from the first valve seating surface 322 disposed on the control valve body 310 to provide fluid communication between the second connective passage 242 and the control pressure source 360, and also maintaining the second surface 354 of the control valve element 350 engaged to the second valve seating surface 262 disposed on the cylindrical valve body 210. The second pressure at point 232 in FIG. 2C is the same pressure applied from the control pressure source 360 (FIG. 1) and to the rear element surface 254 (FIG. 2B).

Figure 3A:
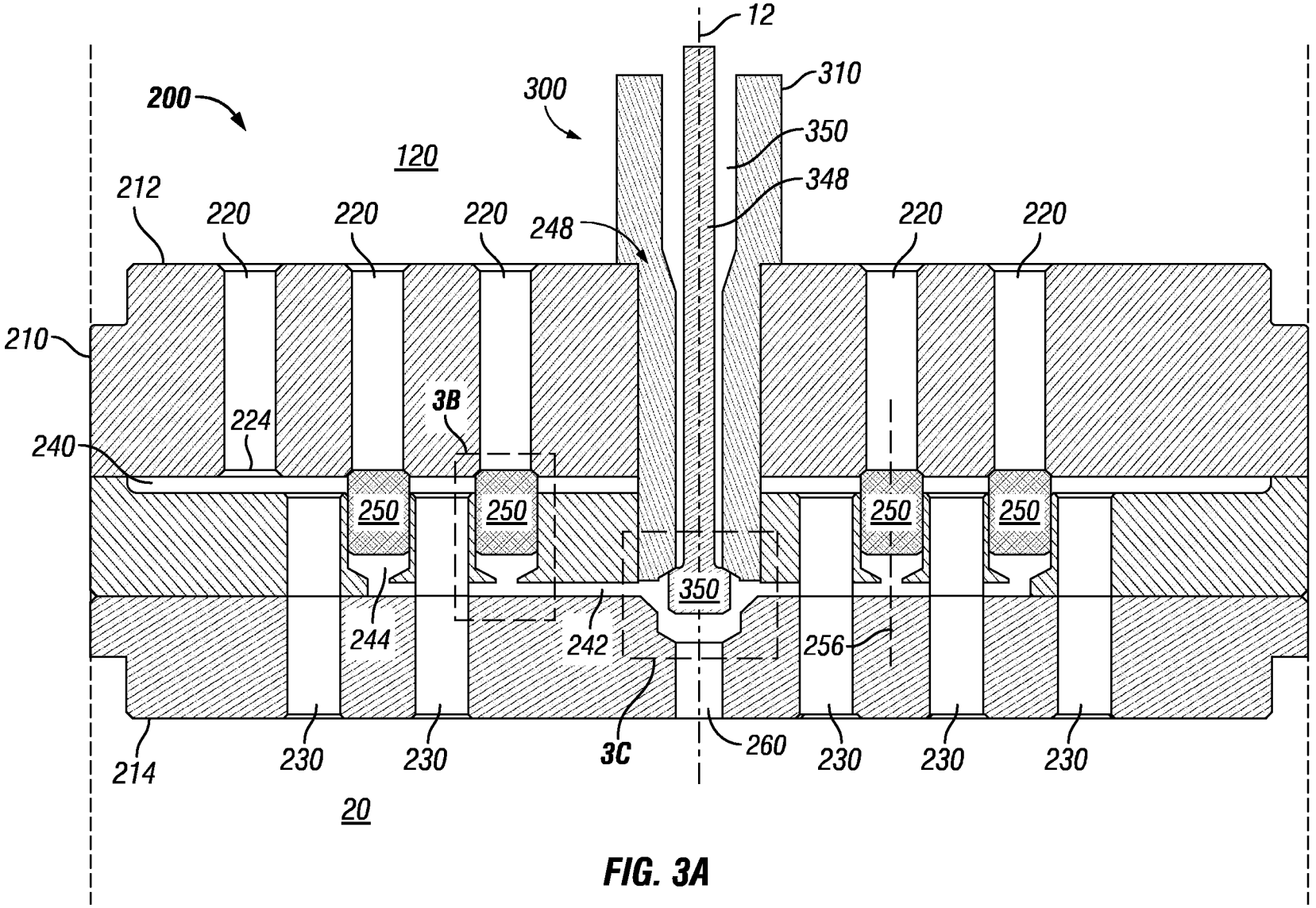
FIGS. 3A-3C depict enlarged views of the valve assembly and the control valve actuator in an inlet valve closed position, according to one or more embodiments.
Figure 3C:
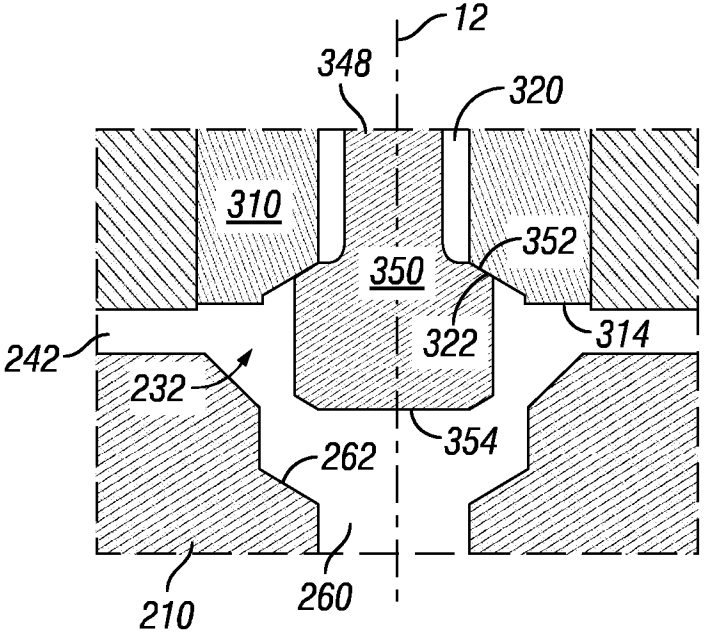
Figure 3B:
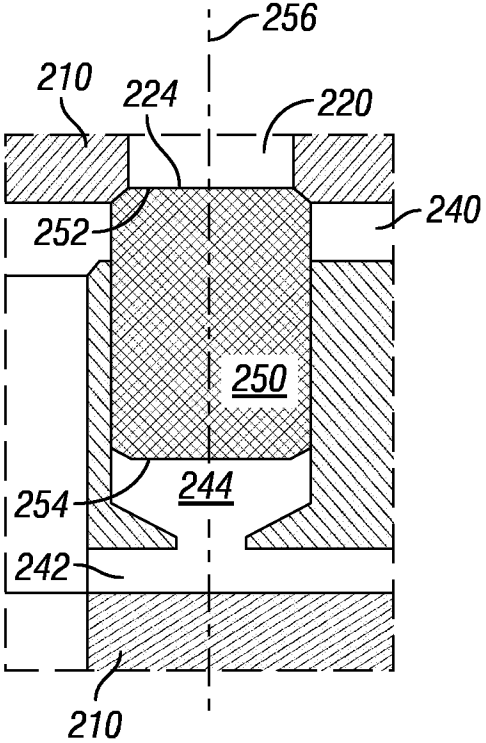

FIGS. 3A-3C depict enlarged views of the valve assembly and the control valve actuator 300 in an inlet valve closed position, such as for ceasing the transfer of the process fluid or gas between the unloader chamber 120 and the cylinder chamber 20, according to one or more embodiments. The flow of the control gas may be ceased and a flow of the cylinder gas may be started to apply a third pressure from the cylinder gas to the rear element surfaces 254 of the inlet valve elements 250. Since the third pressure of the cylinder gas is greater than the first pressure of the process fluid, the inlet valve elements 250 may engage the valve seating surfaces 224 in the closed position.

The third pressure of the cylinder gas may be regulated by maintaining the control valve element 350 engaged with the first valve seating surface 322 and disengaged from the second valve seating surface 262, as depicted in FIG. 3C. More specifically, the third pressure of the cylinder gas may be regulated by maintaining the first surface 352 of the control valve element 350 engaged to the first valve seating surface 322 disposed on the control valve body 310 to cease fluid communication between the second connective passage 242 and the control pressure source 360, and also maintaining the second surface 354 of the control valve element 350 disengaged from the second valve seating surface 262 disposed on the cylindrical valve body 210 and in fluid communication with the cylinder chamber 20 via the port 260. The third pressure at point 232 (FIG. 3C) is the same amount of pressure applied from the cylinder chamber 20 (FIG. 1) and to the rear element surface 254 (FIG. 3B).

Since the third pressure of the cylinder gas applied to the rear element surfaces 254 of the inlet valve elements 250 is greater than the first pressure of the control gas applied to the front element surfaces 252 of the inlet valve elements 250 and therefore the inlet valve elements 250 are moved out at least a portion of the way from the respective valve element port 244 to engage the respective valve seating surface 224 in the closed position, as depicted in FIG. 3B. The process fluid may accumulate in the unloader chamber 120 and the plurality of first valve passages 220 maintaining the first pressure applied to the front element surfaces 252 of the inlet valve elements 250 that is less than the third pressure of the cylinder gas applied to the rear element surfaces 254 of the inlet valve elements 250.

Once the desired pressure in the unloader chamber 120 is reached, the control valve actuator 300 may be adjusted to close the port 260 and open fluid communication between the second connective passage 242 and the control pressure source 360. In turn, the third pressure of the cylinder gas applied to the rear element surfaces 254 of the inlet valve elements 250 is replaced by the second pressure of the control gas, which is less than the first pressure of the process fluid. As such, the inlet valve elements 250 move further into the respective valve element port 244 and disengage from the respective valve seating surface 224, as depicted in FIG. 2B. The cyclic process may be repeated by modulating or otherwise controlling the control valve actuator 300.

Figure 4:
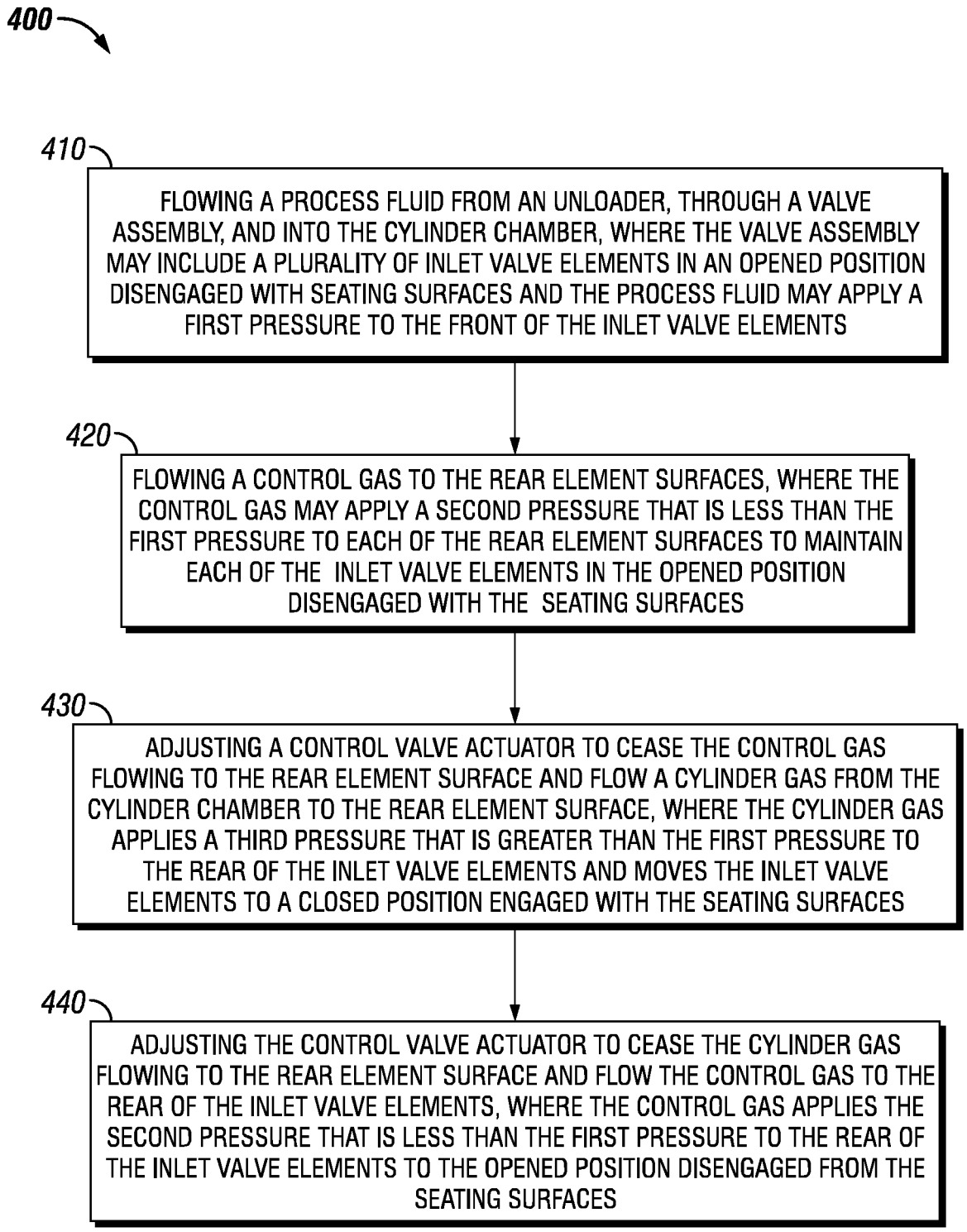
FIG. 4 depicts a flow chart of an illustrative method for unloading an inlet valve system coupled to a cylinder chamber of a reciprocating compressor, according to one or more embodiments.

FIG. 4 depicts a flow chart of an illustrative method 400 for unloading one or more inlet valve systems fluidly coupled to one or more cylinder chambers disposed on one or more reciprocating compressors, according to one or more embodiments.

The method 400 may include flowing a process fluid from an unloader, through a valve assembly, and into the cylinder chamber, as at 410. The valve assembly may include a plurality of inlet valve elements, and each inlet valve element may be disengaged with a valve seating surface in an opened position for providing the process fluid to flow through the valve assembly. Each inlet valve element may have a front element surface and a rear element surface, and the process fluid may apply a first pressure to each of the front element surfaces.

The method 400 may also include flowing a control gas to the rear element surfaces, as at 420. The control gas may apply a second pressure, which may be less than the first pressure, to each of the rear element surfaces to maintain each of the inlet valve elements disengaged with the valve seating surface and in the opened position.

In one or more examples, implementation of 410 and 420 may occur at the same time or at partially overlapping times during the method 400. In some examples of the method 400, 410 may start or finish before, at the same time, or after 420. In other examples of the method 400, 420 may start or finish before, at the same time, or after 410.

The method 400 may include adjusting a control valve actuator to flow a cylinder gas from the cylinder chamber to the rear element surface and cease the control gas flowing to the rear element surface, as at 430. The cylinder gas may apply a third pressure, which may be greater than the first pressure, to each of the rear element surfaces and may move each of the inlet valve elements to engage the valve seating surfaces in a closed position.

The method 400 may also include adjusting the control valve actuator to cease the cylinder gas flowing to the rear element surface and flow the control gas to the rear element surfaces, wherein the control gas may apply the second pressure, which may be less than the first pressure, to each of the rear element surfaces to disengage each of the inlet valve elements from the valve seating surface in the opened position, as at 440.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. An inlet valve system for a cylinder chamber of a reciprocating compressor, comprising:

an unloader comprising a cylindrical unloader body circumferentially disposed about a central axis of the inlet valve system and having an enclosed end opposite an open end, a central bore extending between the enclosed end and the open end within the cylindrical unloader body and defining an unloader chamber, and an inlet passage defined by the cylindrical unloader body and configured to provide fluid communication between the central bore and a location external of the cylindrical unloader body;

a valve assembly comprising a cylindrical valve body circumferentially disposed about the central axis of the inlet valve system and having a first end opposite a second end, a plurality of first valve passages, a plurality of second valve passages, a first connective passage, a second connective passage, a plurality of inlet valve elements disposed in a plurality of valve element ports, and a central bore extending between the first end and the second end of the cylindrical valve body and along the central axis of the inlet valve system, wherein:

the valve assembly is disposed at the open end of the cylindrical unloader body, the plurality of first valve passages extend between the first end of the cylindrical valve body and the first connective passage, and each of the first valve passages has a valve seating surface adjacent the first connective passage, the plurality of second valve passages extend between the second end of the cylindrical valve body and the first connective passage, the second connective passage extends between the plurality of valve element ports and the central bore of the cylindrical valve body, each valve element port at least partially contains a respective inlet valve element of the plurality of inlet valve elements, and each inlet valve element is configured to move between a closed position and an opened position by applying differential gas pressures to a front element surface and a rear element surface of the inlet valve element, engage the valve seating surface of the first valve passage adjacent the first connective passage in the closed position when applying a greater pressure to the rear element surface than the front element surface, and disengage the valve seating surface of the first valve passage adjacent the first connective passage in the opened position when applying a greater pressure to the front element surface than the rear element surface; and a control valve actuator comprising a control valve body circumferentially disposed about the central axis of the inlet valve system and having a first end opposite a second end, a control valve passage of the control valve body extending along the central axis of the inlet valve system, a control valve element disposed in the control valve passage, and a control pressure source fluidly coupled to the control valve passage.

2. The inlet valve system of claim 1, wherein the second connective passage extends between the plurality of valve element ports and the control valve passage of the control valve body.

3. The inlet valve system of claim 1, further comprising:

a first valve seating surface disposed on the control valve body, axially aligned with the control valve element and the control valve passage of the control valve body, and adjacent the second connective passage; and a second valve seating surface disposed on the cylindrical valve body, axially aligned with the control valve element and the central bore of the cylindrical valve body, and adjacent the second connective passage.

4. The inlet valve system of claim 3, wherein a first surface of the control valve element is configured to engage the first valve seating surface disposed on the control valve body, cease fluid communication between the second connective passage and the control pressure source, and enable fluid communication between the second connective passage and the cylinder chamber.

5. The inlet valve system of claim 3, wherein a second surface of the control valve element is configured to engage the second valve seating surface disposed on the cylindrical valve body, cease fluid communication between the second connective passage and the cylinder chamber, and enable fluid communication between the second connective passage and the control pressure source.

6. The inlet valve system of claim 1, wherein each valve seating surface is axially aligned with a respective inlet valve element of the plurality of inlet valve elements and a respective valve element port of the plurality of valve element ports.

7. The inlet valve system of claim 1, wherein the plurality of first valve passages and the plurality of second valve passages extend in a vertical direction parallel with the central axis of the inlet valve system, and wherein each of the first connective passage and the second connective passage independently extends in a horizontal direction perpendicular to the central axis of the inlet valve system.

8. The inlet valve system of claim 1, wherein the control valve element is a reciprocating poppet valve element or a rotary valve element.

9. The inlet valve system of claim 1, wherein the control valve actuator further comprises a direct solenoid, a pneumatic solenoid, a hydraulic solenoid, or any combination thereof.

10. An inlet valve system for a cylinder chamber of a reciprocating compressor, comprising:

an unloader comprising a cylindrical unloader body circumferentially disposed about a central axis of the inlet valve system and having an enclosed end opposite an open end, a central bore extending between the enclosed end and the open end within the cylindrical unloader body and defining an unloader chamber, and an inlet passage defined by the cylindrical unloader body and configured to provide fluid communication between the central bore and a location external of the cylindrical unloader body;

a valve assembly comprising a cylindrical valve body circumferentially disposed about the central axis of the inlet valve system and having a first end opposite a second end, a plurality of first valve passages, a plurality of second valve passages, a first connective passage, a second connective passage, a plurality of inlet valve elements disposed in a plurality of valve element ports, and a central bore extending between the first end and the second end of the cylindrical valve body and along the central axis of the inlet valve system, wherein:

the valve assembly is disposed at the open end of the cylindrical unloader body, the plurality of first valve passages extend between the first end of the cylindrical valve body and the first connective passage, and each of the first valve passages has a valve seating surface adjacent the first connective passage, the plurality of second valve passages extend between the second end of the cylindrical valve body and the first connective passage, the second connective passage extends between the plurality of valve element ports and the central bore of the cylindrical valve body, each valve element port at least partially contains a respective inlet valve element of the plurality of inlet valve elements, and each inlet valve element is configured to move between a closed position and an opened position by applying differential gas pressures to a front element surface and a rear element surface of the inlet valve element; and a control valve actuator comprising:

a control valve body circumferentially disposed about the central axis of the inlet valve system and having a first end opposite a second end, a control valve passage of the control valve body extending along the central axis of the inlet valve system, a control pressure source fluidly coupled to the control valve passage, a control valve element disposed in the control valve passage, a first valve seating surface disposed on the control valve body, axially aligned with the control valve element and the control valve passage of the control valve body, and adjacent the second connective passage, and a second valve seating surface disposed on the cylindrical valve body, axially aligned with the control valve element and the central bore of the cylindrical valve body, and adjacent the second connective passage.

11. The inlet valve system of claim 10, wherein a first surface of the control valve element is configured to engage the first valve seating surface disposed on the control valve body, cease fluid communication between the second connective passage and the control pressure source, and enable fluid communication between the second connective passage and the cylinder chamber.

12. The inlet valve system of claim 10, wherein a second surface of the control valve element is configured to engage the second valve seating surface disposed on the cylindrical valve body, cease fluid communication between the second connective passage and the cylinder chamber, and enable fluid communication between the second connective passage and the control pressure source.

13. The inlet valve system of claim 10, wherein each inlet valve element is configured to engage the valve seating surface of the first valve passage adjacent the first connective passage in the closed position when applying a greater pressure to the rear element surface than the front element surface, and disengage the valve seating surface of the first valve passage adjacent the first connective passage in the opened position when applying a greater pressure to the front element surface than the rear element surface.

14. The inlet valve system of claim 10, wherein each valve seating surface is axially aligned with a respective inlet valve element of the plurality of inlet valve elements and a respective valve element port of the plurality of valve element ports.

15. The inlet valve system of claim 10, wherein the plurality of first valve passages and the plurality of second valve passages extend in a vertical direction parallel with the central axis of the inlet valve system.

16. The inlet valve system of claim 15, wherein each of the first connective passage and the second connective passage independently extends in a horizontal direction perpendicular to the central axis of the inlet valve system.

17. The inlet valve system of claim 10, wherein the control valve element is a reciprocating poppet valve element or a rotary valve element.

18. The inlet valve system of claim 10, wherein the control valve actuator further comprises a direct solenoid, a pneumatic solenoid, a hydraulic solenoid, or any combination thereof.

19. The inlet valve system of claim 10, wherein the second connective passage extends between the plurality of valve element ports and the control valve passage of the control valve body.

* * * * *